US006599161B2

(12) United States Patent
Hunter

(10) Patent No.: US 6,599,161 B2
(45) Date of Patent: Jul. 29, 2003

(54) AIRFOIL LAUNCHING SYSTEM

(76) Inventor: John W. Hunter, 164 W. Mission Ave., Escondido, CA (US) 92025

( * ) Notice: Subject to any disclaimer, the term of this patent is extended or adjusted under 35 U.S.C. 154(b) by 0 days.

(21) Appl. No.: 10/000,274

(22) Filed: Nov. 2, 2001

(65) Prior Publication Data

US 2002/0155779 A1 Oct. 24, 2002

Related U.S. Application Data

(60) Provisional application No. 60/245,267, filed on Nov. 2, 2000.

(51) Int. Cl.[7] ..... A63H 27/127

(52) U.S. Cl. ..... 446/39; 446/64; 124/20.1

(58) Field of Search ..... 446/39, 45, 63, 446/64, 65; 124/10, 79, 20.1, 41.1

(56) References Cited

U.S. PATENT DOCUMENTS 3,949,731 A * 4/1976 Caso
4,050,438 A * 9/1977 Pfotenhauer
4,154,012 A * 5/1979 Miller
4,169,453 A * 10/1979 Hunsicker
4,291,663 A * 9/1981 Buck et al.
4,335,701 A * 6/1982 Bozich
5,125,388 A * 6/1992 Nicely et al. ..... 124/20.1
5,970,970 A * 10/1999 Vanek et al. ..... 124/16
6,079,398 A * 6/2000 Grimm ..... 124/16

* cited by examiner

*Primary Examiner*—Derris H. Banks
*Assistant Examiner*—Ali Abdelwahed
(74) *Attorney, Agent, or Firm*—Thompson E. Fehr

(57) ABSTRACT

An airfoil launching system having a rod with a structure attached to a first end of the rod. A pusher holds a ring airfoil and has a sufficient coefficient of friction that the ring airfoil will generally rotate with the pusher and is rotatably and slidably mounted on the rod. Propulsive force is provided by resilient bands connected to the structure outward from the rod and to the pusher outward from the central aperture of the pusher. A string guide is rotatably attached to the rod and has apertures through which generally non-resilient cords, the first ends of which are attached to the pusher outward from the central aperture, pass. The second ends of the generally non-resilient cords are connected to each other, preferably with a pliable grip.

16 Claims, 2 Drawing Sheets

AIRFOIL LAUNCHING SYSTEM

CROSS-REFERENCE TO RELATED APPLICATION

This is a continuation-in-part of copending U.S. provisional application Serial No. 60/245,267, filed on Nov. 2, 2000.

BACKGROUND OF THE INVENTION

1. Field of the Invention

This invention relates to a launcher for a ring airfoil projectile.

2. Description of the Related Art

There are a number of devices for launching projectiles.

U.S. Pat. No. 4,154,012 employs a rod within a barrel to facilitate the launching of a grenade.

U.S. Pat. No. 4,291,663 has a rod containing a helical groove for launching a ball that spins as it moves longitudinally. Lines 63 through 65 in column 3 declare, ". . . the rod 18 is a hollow cylinder with a long, thin aperture 51 describing a portion of a helical path about its exterior." Furthermore, lines 9 through 14 in column 3 explain, ". . . the trigger operating device 22 presses against the trigger (not shown in FIG. 1) of the launcher 24. This releases the launcher 24 which is spring driven to impel the ball 28 along the length of the rod [member] 18 and cause it to be thrown in a line in the direction of the axis of the rod 18." And lines 31 through 35 in column 4 indicate, "It should be noted that in the preferred embodiment the launcher 24 travels a helical path described by the aperture 51 so that a spin is imparted to the ball."

U.S. Pat. Nos. 5,970,970 and 6,079,398 both cover a launching rod having a fixed helical groove or aperture to launch a ring airfoil with a spin having been imparted to the airfoil through interaction of the launch platform with the groove.

The disclosure of U.S. Pat. No. 5,970,970 also explains, "Propelling element 62 is associated with ring airfoil support 60 and is configured to move the ring airfoil support along member 58. Such movement may involve acceleration and deceleration. Propelling element 62 is best seen in FIG. 8. In launcher 20, propelling element 62 takes the form of a spring having two ends, where one end is attached to a knob 82 inside the forward end of member 58 and the other end is attached to pin 78 as it passes through member 58."

U.S. Pat. No. 5,970,970 further clarifies, "Trigger 28 . . . holds ring airfoil support 60 in the first, cocked position, in which energy is stored in the launcher, and releases ring airfoil support 60 upon actuation of the trigger to permit the ring airfoil support to move along member 58 to the second, fired position, in which energy is transferred to the ring airfoil."

Finally, the disclosure in U.S. Pat. No. 5,970,970 says, "Member 58 also may have a channel 68 disposed along at least a portion of its length. This channel may take a number of forms. In launcher 20, channel 68 takes the form of two helical slots disposed on opposite sides of member 58 and making about one-quarter turn along the length of the member." It does not appear that any other embodiment is described in U.S. Pat. No. 5,970,970 for causing the airfoil to rotate.

And U.S. Pat. No. 6,079,398 provides, "further secured over forward end 140 is a launch spring 148 (illustrated as a cylinder and preferably a metal coil spring) and a launch chuck 150. Chuck 150 includes a sleeve portion 152 having an inner diameter 154 in which a pair of tabs (not shown) are formed. The tabs engage slots 138. Slots 138 form a helical twist which causes a rotation of chuck 150 as it moves axially along shaft 100. Launch spring 148 bears between collar 142 and chuck 150, and chuck 150 is retained on forward end 140 by a bumper 156 and a retainer 158 that is secured to forward end 140. Chuck 150 is formed with a plurality of radially outwardly extending arms 160, that are adapted to engage inner surface 46 of a ring airfoil 34, and outwardly extending tabs 162 adapted to engage trailing edge 45 of ring airfoil 34.

None of these patents provide for altering the degree of spin.

SUMMARY OF THE INVENTION

In the airfoil launching system of the present invention the rotation of the airfoil is adjustable and is accomplished with two or more resilient bands. The degree of axial rotation is determined by the amount which a spin guide is rotated about the longitudinal axis of the launch guide. The two resilient bands are angularly rotated by the spin guide to the same extent as is the spin guide.

DESCRIPTION OF THE PREFERRED EMBODIMENT

Figure 1:
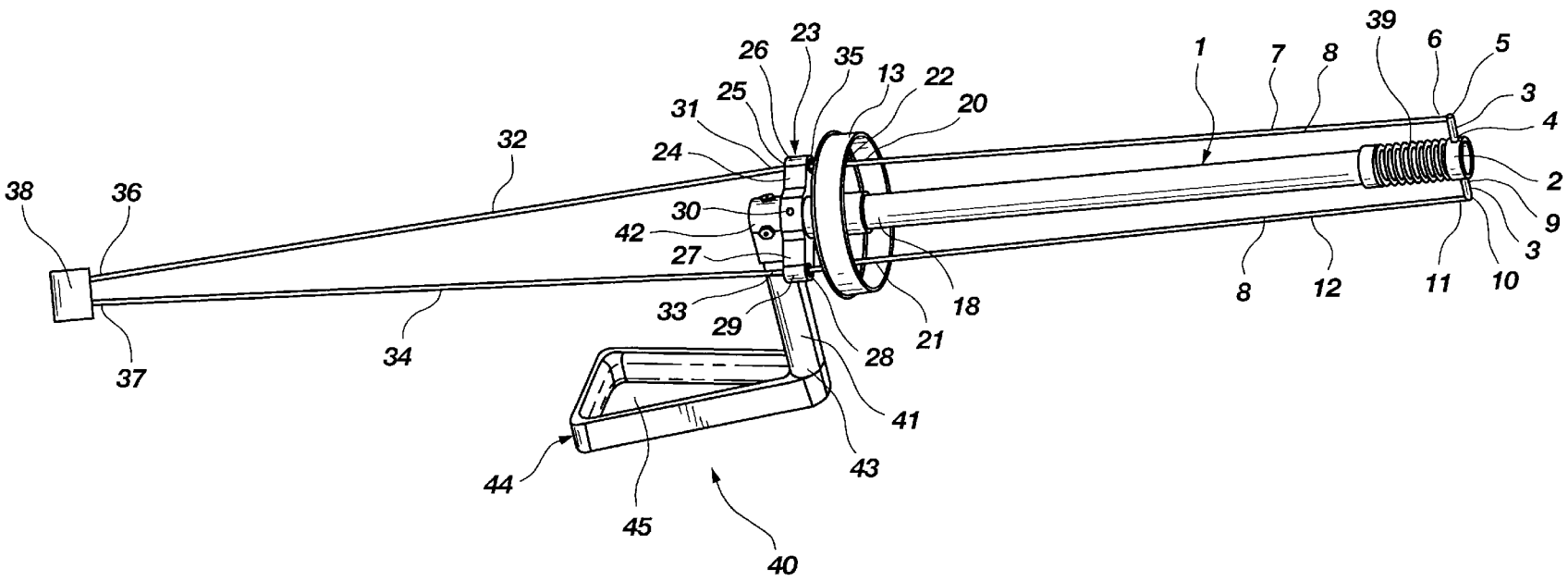
FIG. 1 depicts the airfoil launching system of the present invention.
Figure 2:
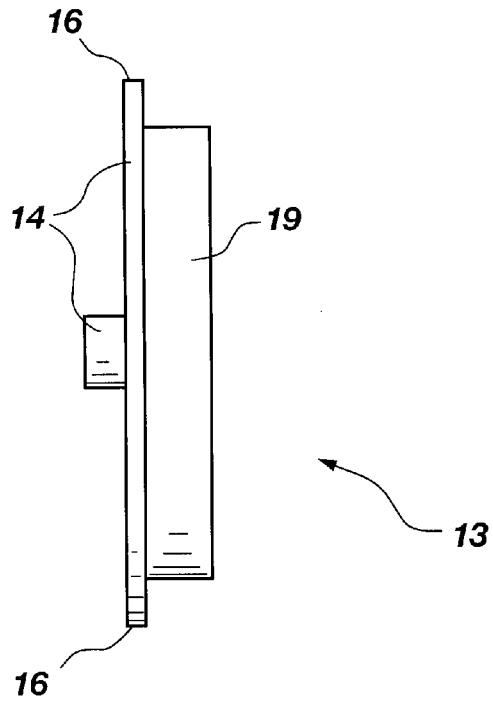
FIG. 2 is a lateral view of a pusher.
Figure 3:
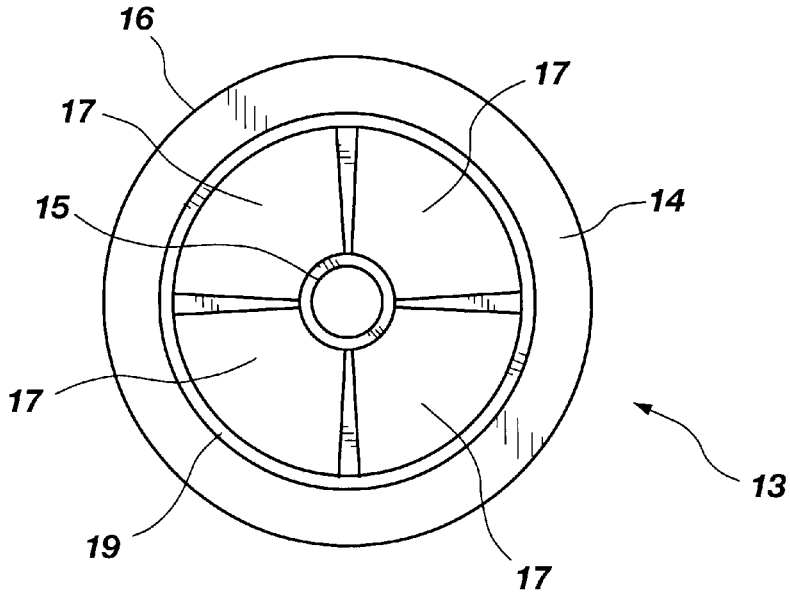
FIG. 3 is a plan view from the front of a pusher.

The present airfoil launching system has a rod 1 termed a "launch guide."

Attached toward a first end 2 of the rod 1 is a support 3 that extends radially outward from the rod 1.

Connected to a first side 4 of the support 3 outward from the rod 1 and preferably, but not necessarily, near a first end 5 of the support 3 is a first end 6 of a first set 7 of resilient bands 8, which set 7 comprises one or more resilient bands 8. Similarly, attached to a second side 9 of the support 3 outward from the rod 1 and preferably, but not necessarily, near a second end 10 of the support 3 is a first end 11 of a second set 12 of resilient bands 8, which set 12 comprises one or more resilient bands 8.

A pusher 13 is a generally disc-shaped structure 14 which contains a central aperture 15; has an outer diameter 16; and preferably, but not necessarily, contains one or more apertures 17 between the central aperture 15 and the outer diameter 16 in order to reduce the air resistance and the weight of the pusher 13.

The central aperture 15 is sized to permit the pusher 13 to rotate and slide along the rod 1, upon which the pusher 13 is mounted between the support 3 and a second end 18 of the rod 1. In order to reduce balloting as the pusher 13 moves along the rod 1, the thickness of the generally disc-shaped structure 14 is preferably, but not necessarily, extended near the central aperture 15.

Inward from the outer diameter 16 of the pusher 13 is a flange 19 which is sized to hold the inner side of a ring airfoil. The material from which the generally disc-shaped structure 14 and preferably, but not necessarily, the entire pusher 13 is constructed is selected to have a coefficient of friction which will cause a ring airfoil placed on the pusher 13 generally to rotate with the pusher 13.

A second end 20 of the first set 7 of resilient bands 8 is attached to the generally disc-shaped structure 14 outward from the central aperture 15; and a second end 21 of the second set 12 of resilient bands 8 is connected to the generally disc-shaped structure 14 outward from the central aperture 15 in a different location from the point of attachment 22 for the first set 7 and preferably, but not necessarily, substantially opposite (across the central aperture 15) to the point of attachment 22 for the first set 7.

Rotatably attached to the rod 1 at a point farther toward the second end 18 of the rod 1 than the pusher 13 is located is a string guide 23 that extends radially outward from the rod 1.

A first side 24 of the string guide 23 contains an aperture 25 outward from the rod 1 and preferably, but not necessarily, near a first end 26 of the string guide 23. Similarly a second side 27 of the string guide 23 contains an aperture 28 outward from the rod 1 and preferably, but not necessarily, near a second end 29 of the string guide 23.

The string guide 23 contains any mechanism that is well known in the art, such as a set screw 30, for locking the string guide 23 to stop rotation about the rod 1.

A first end 31 of a first generally non-resilient cord 32 is attached to the generally disc-shaped structure 14 of the pusher 13 outward from the central aperture 15; and a first end 33 of a second generally non-resilient cord 34 is connected to the generally disc-shaped structure 14 of the pusher 13 outward from the central aperture 15 in a different location from the point of attachment 35 for the first non-resilient cord 32 and preferably, but not necessarily, substantially opposite (across the central aperture 15) to the point of attachment 35 for the first generally non-resilient cord 32.

The first generally non-resilient cord 32 passes through the aperture 25 in the first side 24 of the string guide 23, and the second generally non-resilient cord 34 passes through the aperture 28 in the second side of the string guide 23. Thus, the degree of rotation of the string guide 23 with respect to the support 3 determines the spin provided to the ring airfoil, which will determine the pattern such airfoil flies.

After passing through the apertures 25, 28 a second end 36 of the first generally non-resilient cord 32 and a second end 37 of the second generally non-resilient cord 34 are connected to one another, either directly or preferably, but not necessarily, by each being connected to a pliable grip 38.

Preferably, but not necessarily, a bumper 39 is connected to the rod 1 near the support 3 and on the side of the support 3 that is toward the pusher 13. Such a bumper 39 cushions the impact of the pusher 13. The bumper 39 can be any shock-absorbing device that is known in the art but is preferably a spring.

Also preferably, but not necessarily, a handle 40 is attached near the second end 18 of the rod 1. Preferably, but not necessarily, this handle 40 has a portion 41 with a first end 42 that is attached to the rod 1 and extends at an angle from the rod 1. Connected to a second end 43 of the portion 41 is a section 44 that is generally parallel to the rod 1 and contains an aperture 45 to accommodate the wrist of a user.

In operation a user adjusts he string guide 23 for the desired rotation of an airfoil, places an airfoil on the pusher 13, place a hand through the aperture 45, grips the portion 41 of the handle 40, pulls the pliable grip 38 toward himself or herself, and then releases the grip 38. The pusher 13 and, consequently, the airfoil will be pulled by the resilient bands 8 toward the support 3 and rotated. The bumper 39 will stop the pusher 13, and the airfoil will spin and fly forward.

I claim:

1. An airfoil launching system, which comprises:

a rod having a first end and a second end;

a support having a first side and a second side, being attached to said rod, and extending radially outward from said rod;

a first set of resilient bands, said first set having a first end and a second end and having the first end connected to said support outward from said rod;

a second set of resilient bands, said second set having a first end and a second end and having the first end connected to said support outward from said rod;

a pusher slidably mounted on said rod between said support and the second end of said rod, said pusher comprising:

a generally disc-shaped structure containing a central aperture sized to permit said pusher to rotate and to slide along said rod and having an outer diameter, wherein aid generally disc-shaped structure is composed of material having a coefficient of friction which will cause a ring airfoil placed on said pusher generally to rotate with said pusher and wherein a second end of said first set of resilient bands as well as a second end of said second set of resilient bands is attached to said generally disc-shaped structure at points of attachment outward from the central aperture; and a flange attached to said generally disc-shaped structure inward from the outer diameter of said generally disc-shaped structure wherein, said flange is sized to hold an inner side of a ring airfoil;

a string guide rotatably attached to said rod at a point closer toward the second end of said rod than said pusher is located, said string guide extending radially outward from said rod; having a first side containing an aperture outward from the rod, having a second side containing aperture outward from the rod, and having a means for stopping rotation of said string guide about said rod;

a first generally non-resilient cord having a first end attached, at a point of attachment, to said generally disc-shaped structure outward from the central aperture, having a second end, and passing through the aperture in the first side of said string guide; and a second generally non-resilient cord having a first end connected to said generally disc-shaped structure outward from the central aperture in a different location from the point of attachment for said first generally non-resilient cord, having a second end, passing through the aperture in the second side of said string guide, and having the second end of said second generally non-resilient cord connected to the said second end of said first generally non-resilient cord.

2. The airfoil launching system as recited in claim 1, wherein:

the second end of said second set of resilient bands is attached to said generally disc-shaped structure substantially opposite, with reference to the central aperture, to the point of attachment for said first set of resilient bands; and the first end of said second generally non-resilient cord is connected to said generally disc-shaped structure substantially opposite, with reference to the central aperture, to the point of attachment for said first generally non-resilient cord.

3. The airfoil launching system as recited in claim 2, wherein:

the second end of said second generally non-resilient cord connected to the said second end of said first generally non-resilient cord with a pliable grip.

4. The airfoil launching system as recited in claim 3, further comprising:

a handle attached near the second end of said rod, said handle comprising:

a portion with a first end and a second end, said first end being a segment of said handle that is attached to the second end of said rod and said first end extending at an angle from said rod; and a section being generally parallel to said rod, containing an aperture to accommodate a wrist of a user, and being connected to the second end of said portion of said handle.

5. The airfoil launching system as recited in claim 4, further comprising:

a bumper connected to said rod near said support and on a side of said support that is toward said pusher.

6. The airfoil launching system as recited in claim 3, further comprising:

a bumper connected to said rod near said support and on a side of said support that is toward said pusher.

7. The airfoil launching system as recited in claim 2, further comprising:

a handle attached near the second end of said rod, said handle comprising:

a portion with a first end and a second end, said first end being a segment of said handle that is attached to the second end of said rod and said first end extending at an angle from said rod; and a section being generally parallel to said rod, containing an aperture to accommodate a wrist of a user, and being connected to the second end of said portion of said handle.

8. The airfoil launching system as recited in claim 7, further comprising:

a bumper connected to said rod near said support and on a side of said support that is toward said pusher.

9. The airfoil launching system as recited in claim 2, further comprising:

a bumper connected to said rod near said support and on a side of said support that is toward said pusher.

10. The airfoil launching system as recited in claim 1, wherein:

the second end of said second generally non-resilient cord connected to the said second end of said first generally non-resilient cord with a pliable grip.

11. The airfoil launching system as recited in claim 10, further comprising:

a handle attached near the second end of said rod, said handle comprising:

a portion with a first end and a second end, said first end being a segment of said handle that is attached to the second end of said rod and said first end extending at an angle from said rod; and a section being generally parallel to said rod, containing an aperture to accommodate a wrist of a user, and being connected to the second end of said portion of said handle.

12. The airfoil launching system as recited in claim 11, further comprising:

a bumper connected to said rod near said support and on a side of said support that is toward said pusher.

13. The airfoil launching system as recited in claim 10, further comprising:

a bumper connected to said rod near said support and on a side of said support that is toward said pusher.

14. The airfoil launching system as recited in claim 1, further comprising:

a handle attached near the second end of said rod, said handle comprising:

a portion with a first end and a second end, said first end being a segment of said handle that is attached to the second end of said rod and said first end extending at an angle from said rod; and a section being generally parallel to said rod, containing an aperture to accommodate a wrist of a user, and being connected to the second end of said portion of said handle.

15. The airfoil launching system as recited in claim 14, further comprising:

a bumper connected to said rod near said support and on a side of said support that is toward said pusher.

16. The airfoil launching system as recited in claim 1, further comprising:

a bumper connected to said rod near said support and on a side of said support that is toward said pusher.

* * * * *